US009833878B2

(12) United States Patent
Nguyen

(10) Patent No.: US 9,833,878 B2
(45) Date of Patent: Dec. 5, 2017

(54) METHOD AND APPARATUS FOR DEBURRING A SURFACE

(71) Applicant: Cuong Van Nguyen, Westminster, CA (US)

(72) Inventor: Cuong Van Nguyen, Westminster, CA (US)

( * ) Notice: Subject to any disclaimer, the term of this patent is extended or adjusted under 35 U.S.C. 154(b) by 118 days.

(21) Appl. No.: 14/444,768

(22) Filed: Jul. 28, 2014

(65) Prior Publication Data

US 2016/0001421 A1 Jan. 7, 2016

Related U.S. Application Data

(60) Provisional application No. 62/020,903, filed on Jul. 3, 2014.

(51) Int. Cl.
*B24B 23/03* (2006.01)
*B24D 9/08* (2006.01)

(52) U.S. Cl.
CPC ..... *B24D 9/08* (2013.01); *B24B 23/03* (2013.01)

(58) Field of Classification Search
CPC ..... B24B 23/03; B24B 23/04; B24D 9/04; B24D 9/08
USPC ..... 451/357
See application file for complete search history.

(56) References Cited

U.S. PATENT DOCUMENTS

| | | | | | |
|---|---|---|---|---|---|
| 4,287,685 | A * | 9/1981 | Marton | B24D 9/08 | 451/359 |
| 4,854,085 | A * | 8/1989 | Huber | B24B 23/03 | 451/357 |
| 5,349,786 | A * | 9/1994 | Dorrah | B24B 23/03 | 451/357 |
| 5,823,862 | A * | 10/1998 | Heidelberger | B24B 23/03 | 403/22 |
| 6,059,644 | A * | 5/2000 | Manor | B24D 9/08 | 451/353 |
| 6,361,424 | B1 * | 3/2002 | Manor | B24D 9/08 | 451/353 |
| 7,118,467 | B2 * | 10/2006 | Sun | B24B 23/02 | 451/344 |
| 2005/0079808 | A1 * | 4/2005 | Tiede | B24B 23/04 | 451/357 |
| 2009/0239451 | A1 * | 9/2009 | Geiser | B25F 5/001 | 451/58 |
| 2014/0187127 | A1 * | 7/2014 | Zapp | B24B 23/03 | 451/59 |

* cited by examiner

*Primary Examiner* — Eileen Morgan
(74) *Attorney, Agent, or Firm* — Stetina Brunda Garred and Brucker

(57) ABSTRACT

A method and apparatus for deburring a metallic surface is disclosed. The method and apparatus utilizes a handheld orbital sander that is compact so that machine marks disposed in tight places can be reached. Additionally, a conformable sanding pad is utilized to allow the sanding pad to conform to the unique contours of the metallic surface to eliminate the machining marks.

14 Claims, 10 Drawing Sheets

METHOD AND APPARATUS FOR DEBURRING A SURFACE

CROSS-REFERENCE TO RELATED APPLICATIONS

This application claims the benefits of U.S. provisional patent application Ser. No. 62/020,903, filed on Jul. 3, 2014, the entire contents of which is expressly incorporated herein by reference.

STATEMENT RE: FEDERALLY SPONSORED RESEARCH/DEVELOPMENT

Not Applicable

BACKGROUND

The various embodiments and aspects described herein are directed to a method and apparatus for deburring a surface.

In machining a metallic component, the component may have a series of machine marks such as swirls and ridges. To eliminate these machine marks, the marks are typically sanded by hand or with a rotary grinder. However, these methods are slow and sometimes ineffective due to the contour of the machined surface.

Accordingly, there is a need in the art for an improved method and apparatus for deburring a metallic surface.

BRIEF SUMMARY

The various embodiments and aspects described herein address the needs discussed above, discussed below and those that are known in the art.

A handheld orbital sander is disclosed. The handheld orbital sander may be operated with one hand and have a sanding attachment that is capable of conforming to the contour of the metallic surface. In particular, the sanding attachment has a threaded shaft that engages a chuck of the handheld orbital sander and a flat landing that helps to stabilize the sanding attachment during use. The flat landing engages the chuck to provide additional support to mitigate wobbling of the sanding attachment during rotational movement thereof. Additionally, the orbital sander is operable with one hand and the orbital sander is a compact unit. As such, the chuck of the orbital sander must optimize space to prevent interference with rotational movement of the sanding attachment. In order to do so, the chuck has an offset cylindrical recess to impart orbital motion to the rotational movement of the sanding attachment. A bearing with threaded inner race is retained within the offset cylindrical recess with a retaining ring that does not protrude inward toward the inner race. This mitigates any interference between the sanding attachment and the chuck that might prevent rotational movement of the sanding attachment during operation of the handheld orbital sander.

More particularly, a sanding attachment attachable to an orbital sander for deburring machine marks on a metallic surface is disclosed. The attachment may comprise a sanding disc and a pad. The sanding disc may have a circular configuration defining a periphery. The disc may have a rough side and a mounting side. The rough side may be substantially flat and have a grit selected for sanding down the machine marks. The mounting side may have a threaded nub.

The pad may have a flexible support for the sanding disc, a rigid base removably attachable to the sanding disc and a threaded shank removably attachable to a chuck of the orbital sander. The base may have a flat area adjacent to the threaded shank that contacts the chuck of the orbital sander to provide additional support during orbital rotation of the chuck.

An outer peripheral portion of the flexible support may be more bendable compared to the rigid base. The outer peripheral portion of the flexible support may be sufficiently bendable so that the sanding disc is capable of deburring an inside corner having a ¼ inch radius.

A central portion of the support may have a threaded hole for receiving the threaded nub of the sanding disc.

The flat area of the base may contact a face of the chuck of the orbital sander.

In another aspect, a deburring kit for deburring machine marks on a metallic surface is disclosed. The kit may comprise a mini orbital sander and a sanding attachment. The mini orbital sander may be small enough to be held and operated with one hand. The sander may have an orbital attachment. The orbital attachment may have an inner member that rotates with respect to an outer member. The outer member may be retained within a housing. The inner member may have a flat face for engagement with a sanding attachment. The inner member may have a threaded hole.

The sanding attachment comprise a sanding disc and a pad. The sanding disc may have a circular configuration defining a periphery. The disc may have a rough side and a mounting side. The rough side may be substantially flat and have a grit selected for sanding down the machine marks. The mounting side may have a threaded nub that can be engaged to the threaded hole of the inner member.

The pad may have a flexible support for the sanding disc, a rigid base removably attachable to the sanding disc and a threaded shank removably attachable to a chuck of the orbital sander. The base may have a flat area adjacent to the threaded shank that contacts the flat face of the inner member to provide additional support during orbital rotation of the sanding attachment and the housing.

An outer peripheral portion of the flexible support may be more bendable compared to the rigid base. The outer peripheral portion of the flexible support may be sufficiently bendable so that the sanding disc is capable of deburring an inside corner having a ¼ inch radius.

A central portion of the support may have a threaded hole for receiving the threaded nub of the sanding disc.

The inner and outer members may form a bearing held within the chuck with a retaining ring. The retaining ring may have a generally circular shape and be sized and configured to fit within a groove formed in an inner surface of the chuck. The general circular shape of the retaining ring defines curved opposed distal portions so that the retaining ring does not protrude inward and interfere with rotation of the pad. The retaining ring protrudes inward a constant distance around the entire periphery to provide a constant clearance when the sanding attachment is screwed onto the chuck so that the sanding attachment freely rotates during use.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
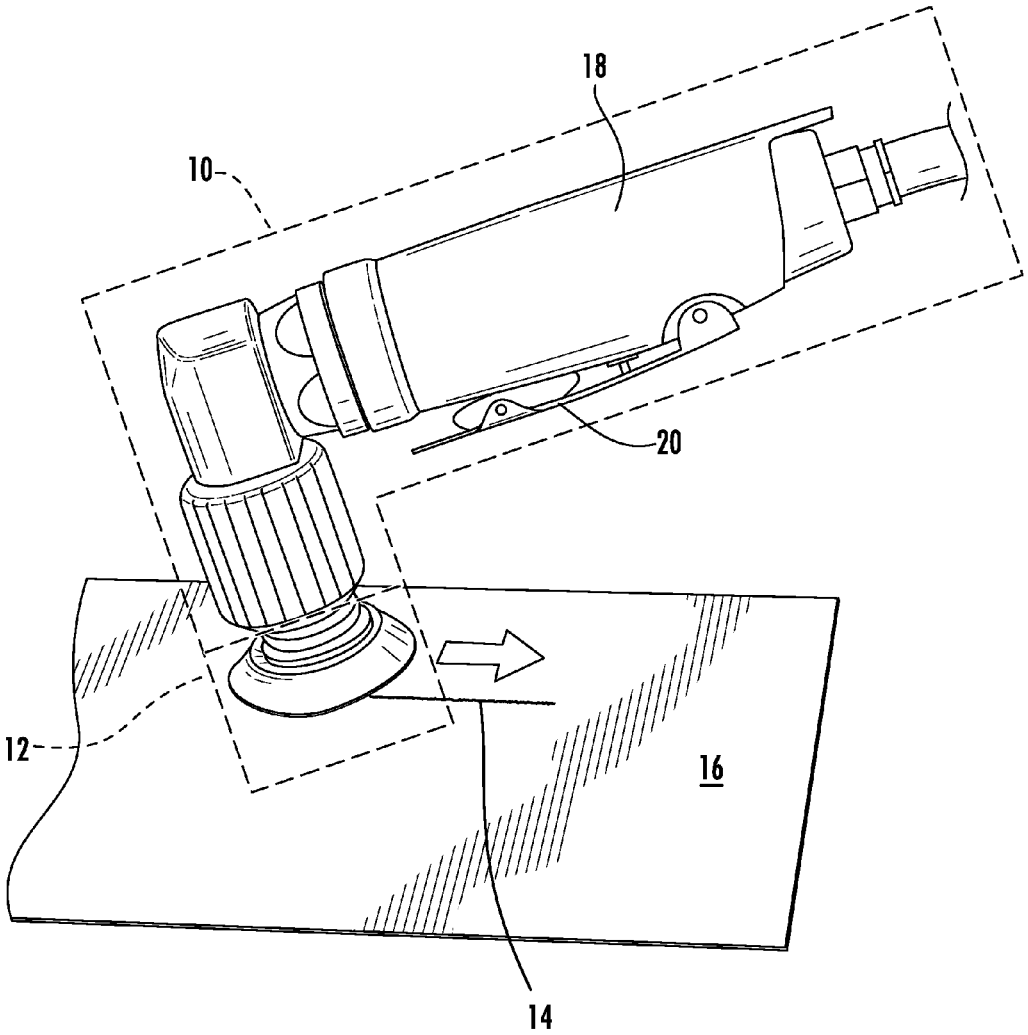
FIG. 1 is a perspective view of a handheld orbital sander with a conformable sanding pad for eliminating machining marks on a metallic surface.

Referring now to the drawings, a compact handheld orbital sander 10 with a sanding pad 12 for deburring a machine mark 14 off a metallic surface 16 is shown. The sanding pad 12 rotates in two different rotational axes which are parallel to each other. Also, the sanding pad 12 has an outer peripheral portion which is conformable to the metallic surface 16 so that the user may press down on the metallic surface 16 to conform the outer peripheral portion 68 of the sanding pad 12 to the contour of the metallic surface 16 for deburring machine mark 14. To operate the orbital sander 10, the user grips the body 18 of the sander 10 and depresses the trigger 20. The orbital sander 10 is a pneumatic operated sander and rotates the sanding pad 12 about a first rotational axis. Also, the first rotational axis is rotated about a second rotational axis which is parallel to the first rotational axis. By providing a compact handheld orbital sander 10 with the sanding pad 12, the user may efficiently and effectively deburr and eliminate machine marks 14 from a metallic surface 16.

Figure 2:
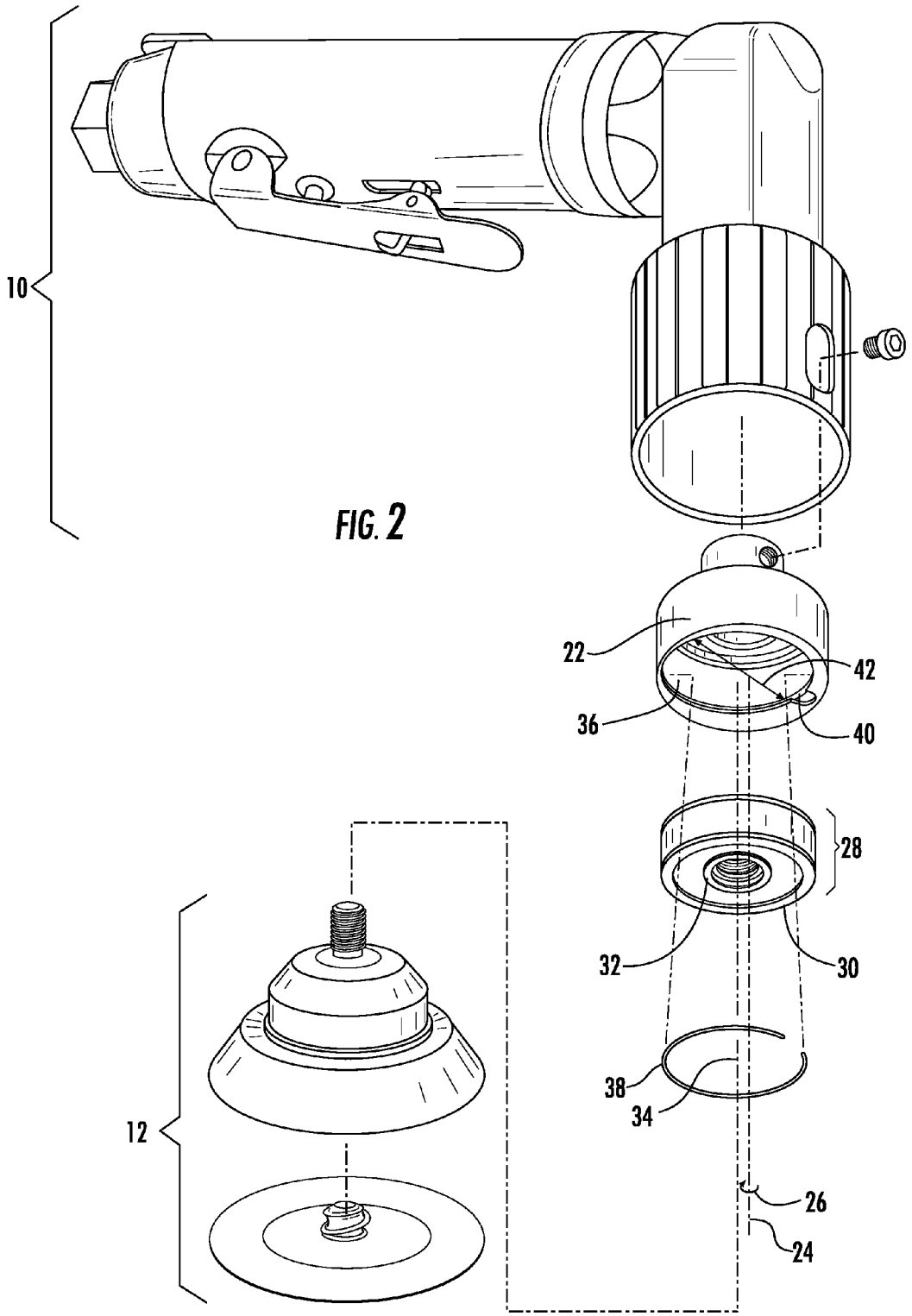
FIG. 2 is an exploded perspective view of the handheld orbital sander and the sanding pad.
Figure 2A:
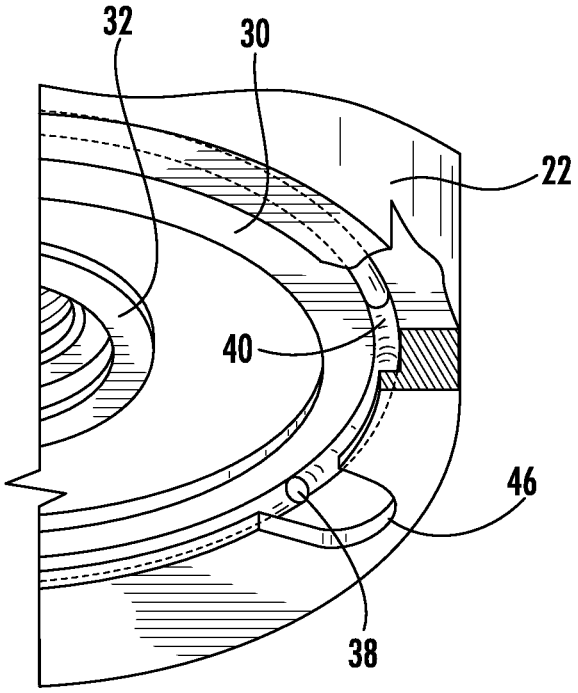
FIG. 2A is an enlarged perspective view of a chuck of the handheld orbital sander.

Referring now to FIG. 2, the orbital sander 10 has a chuck 22. This chuck 22 rotates about rotational axis 24 in the direction of arrow 26. Additionally, the chuck 22 has an inner bearing 28 having an outer race 30 and an inner race 32. The outer race 30 is secured to the chuck 22 and rotates off of its central axis 34. The inner race 32 rotates about the central axis 34. Moreover, the inner race 32 is attached to the outer race 30 by way of ball bearings. As such, the inner race 32 does not necessarily rotate at the same rotational speed as the outer race 30. When the sanding pad 12 is attached to the chuck 22, the sanding pad 12 rotates about both axes 24, 34. This provides superior deburring capabilities to remove machine marks 14 on a metallic surface 16.

The orbital sander 10 may have a custom chuck 22 for allowing the sanding pad 12 to be securely mounted to the chuck 22 so that the sanding pad 12 does not wobble during deburring operations and rotates freely. More particularly, the chuck 22 may have a cylindrical configuration and may be mounted to an arbor of the orbital sander 10. The arbor of the orbital sander 10 rotates the chuck 22 about its central axis 34 which is also the rotational axis 24. The chuck 22 has a cylindrical recess 36 which receives the inner bearing 28. The inner bearing 28 is frictionally mounted to the chuck 22 in that an outer diameter of the inner bearing 28 may be press fit into the cylindrical recess 36. To retain the inner bearing 28 in the cylindrical recess 36, an retaining ring 38 may be disposed within a groove 40 formed in the inner surface of the cylindrical recess 36.

The retaining ring 38 may be a resilient elongate curved member. The retaining ring 38 when not disposed within the grooves 40 (i.e., in its natural state) is larger than an inner diameter 42 of the cylindrical recess 36. When the retaining ring 38 is installed, the inner bearing 28 is completely disposed within the cylindrical recess 36 and the groove 40 is exposed. The retaining ring 38 is pushed into the groove 40 and springs outward so that the retaining ring 38 is retained within the grooves 40 to prevent the inner bearing 28 from being dislodged out of the chuck 22 during use.

The retaining ring 38 is slender and does not protrude inward to provide as much space for the sanding pad 12. Moreover, the retaining ring may have a constant diameter so that the retaining ring 38 protrudes inward at most a thickness of the retaining ring 38. The sanding pad 12 is connected solely to the inner race 32 so that during rotation of the chuck 22, the sanding pad 12 does not contact other parts to prevent rotation of the sanding pad 12 during operation.

Figure 3:
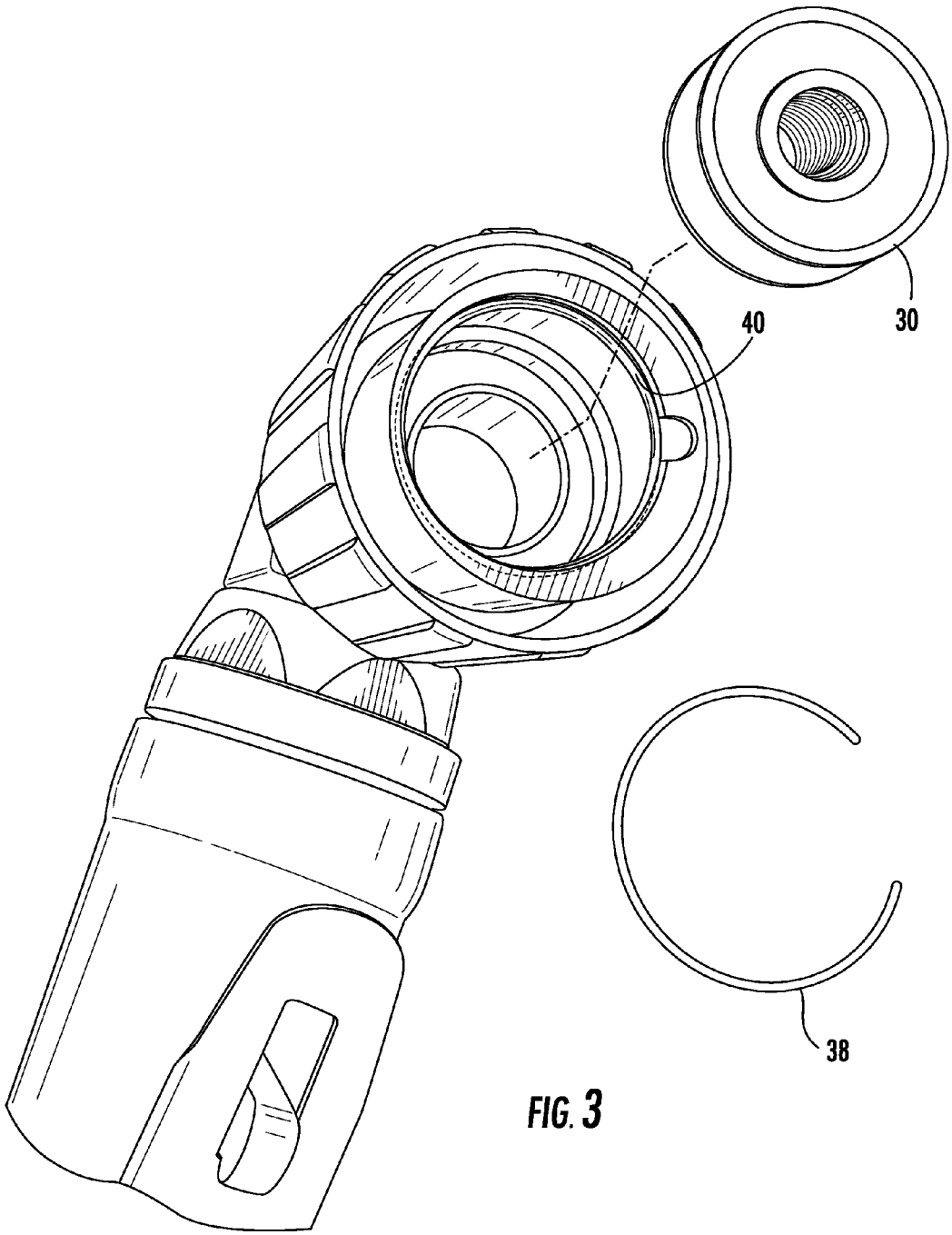
FIG. 3 is an exploded perspective view of a chuck of the handheld orbital sander.
Figure 4:
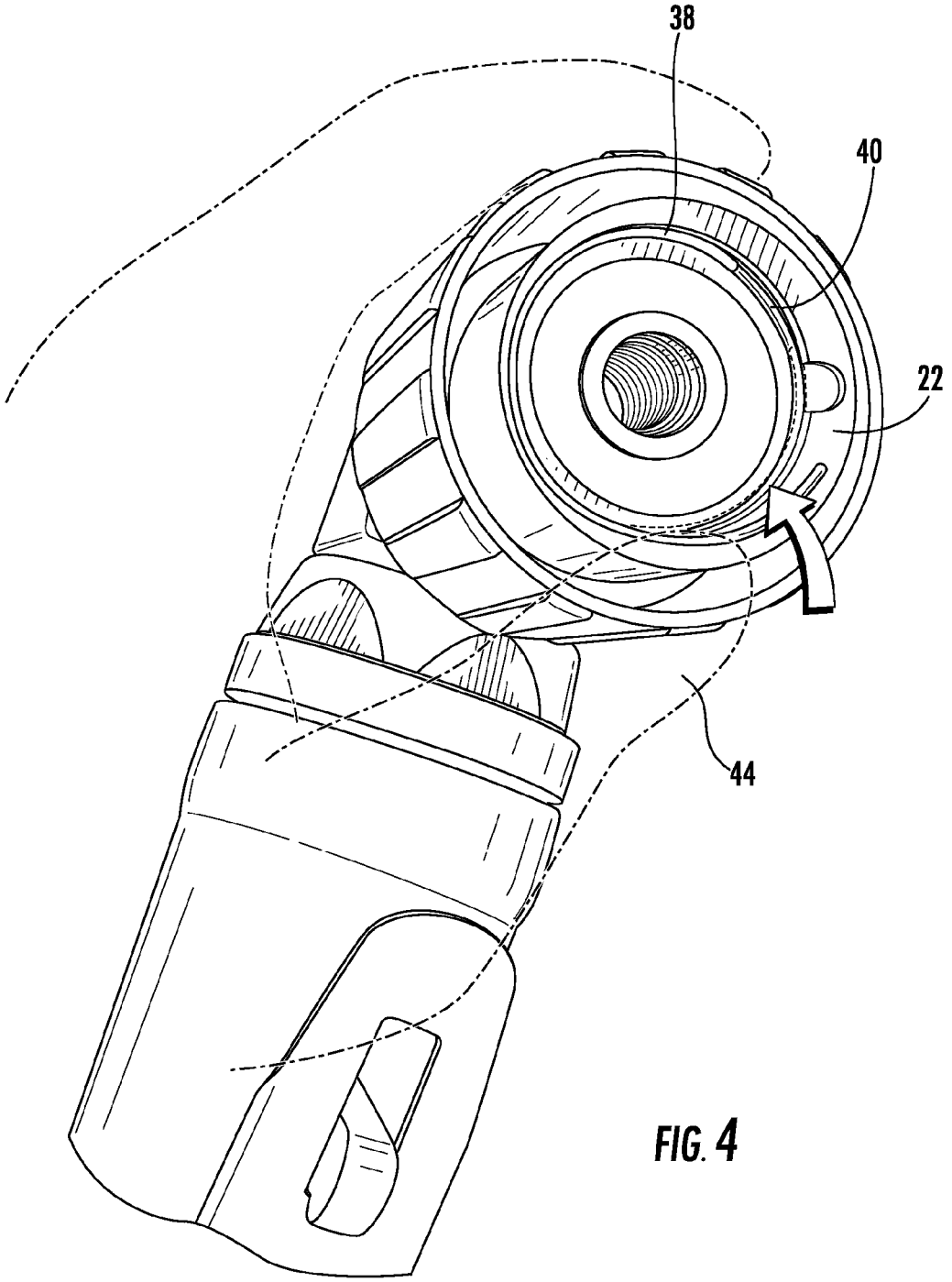
FIG. 4 is an exploded perspective view of the chuck of the handheld orbital sander illustrating insertion of a retaining ring within a groove of the chuck.
Figure 5:
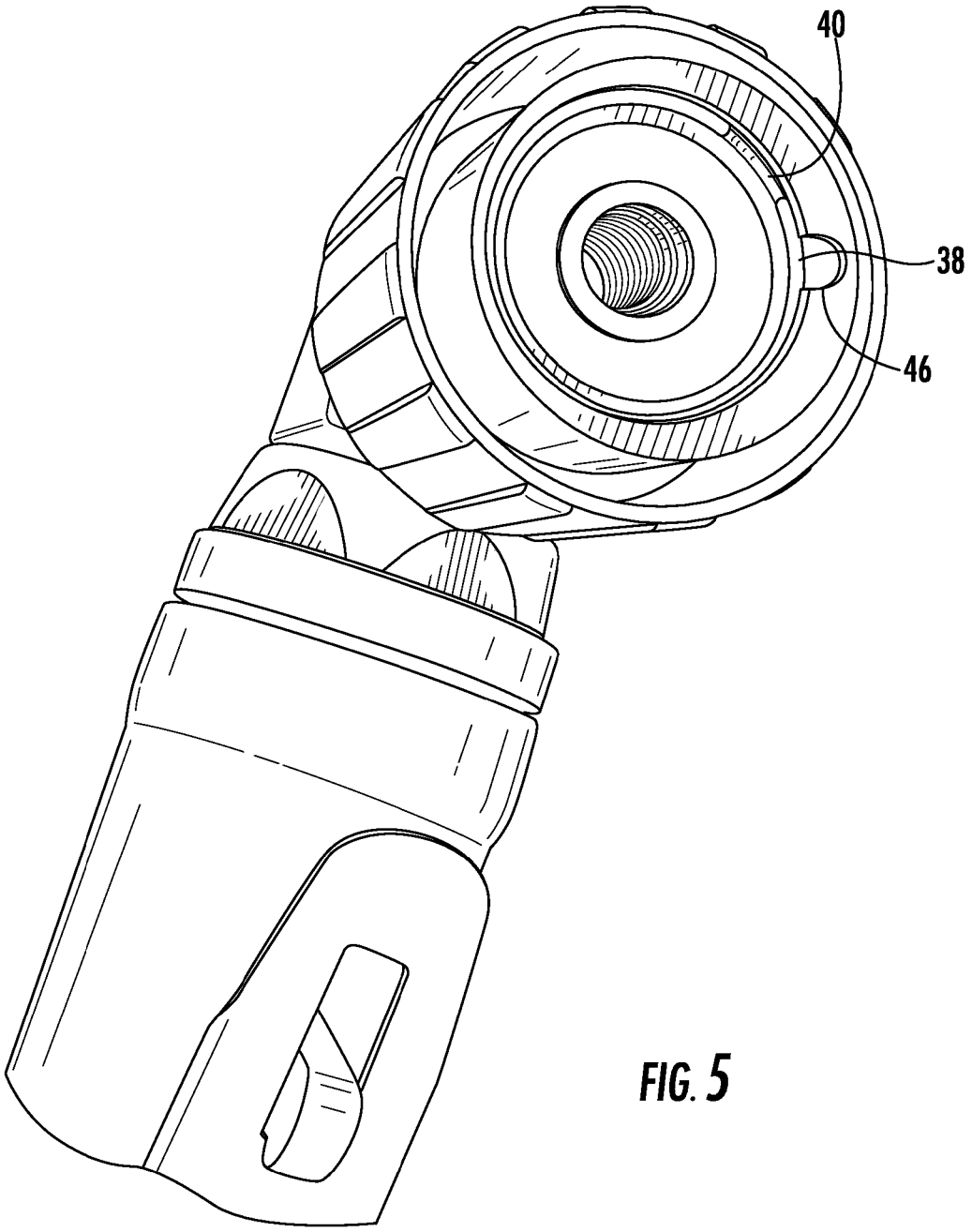
FIG. 5 is a perspective view of the Chuck of the handheld orbital sander with the retaining ring inserted into the groove of the chuck.
Figure 6:
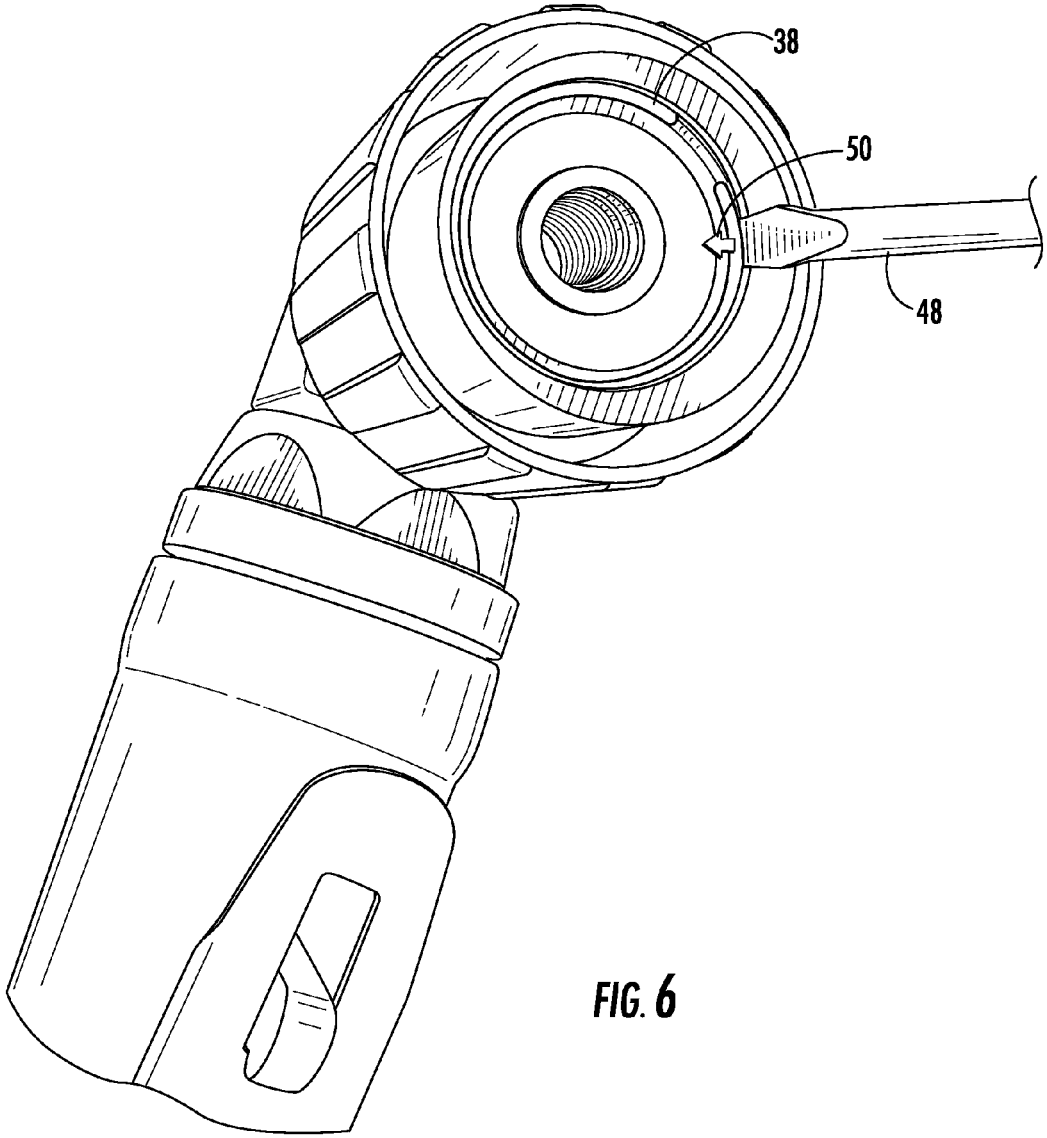
FIG. 6 is a perspective view of the chuck of the handheld orbital sander with a screwdriver used to remove the retaining ring from the groove of the chuck.

To assemble the chuck 22, the inner bearing 28 is pushed into the cylindrical recess 36. The inner bearing 28 is completely disposed within the cylindrical recess 36 and the groove formed on the inner surface of the cylindrical recess 36 is exposed and can receive the retaining ring 38. Referring now to FIG. 3, once the inner bearing 28 is disposed within the cylindrical recess 36, the retaining ring 38 is positioned in the cylindrical recess 36 as shown in FIG. 4. Initially, one side of the retaining ring 38 is disposed within the grooves 40. The other side of the retaining ring 38 overhangs the chuck 22. The user pushes the portion of the retaining ring 38 that overhangs the chuck 22 with his or her thumb 44 toward the center of the chuck 22. The retaining ring 38 material is selected so that pressure from the thumb may be capable of sufficiently deflecting the retaining ring 38 to lodge the retaining ring 38 into the groove 40 of the cylindrical recess 36. When the retaining ring 38 is disposed within the groove 40, as shown in FIG. 5, the retaining ring 38 protrudes inward and blocks the inner bearing 28 from vibrating out of the cylindrical recess 36 during operation. The opposed distal end portions do not protrude inward as in prior art retaining rings. In this manner, the sanding pad 12 does not contact the retaining ring 38 or any other part to prevent or hamper rotation of the sanding pad 12 during operation.

Figure 7:
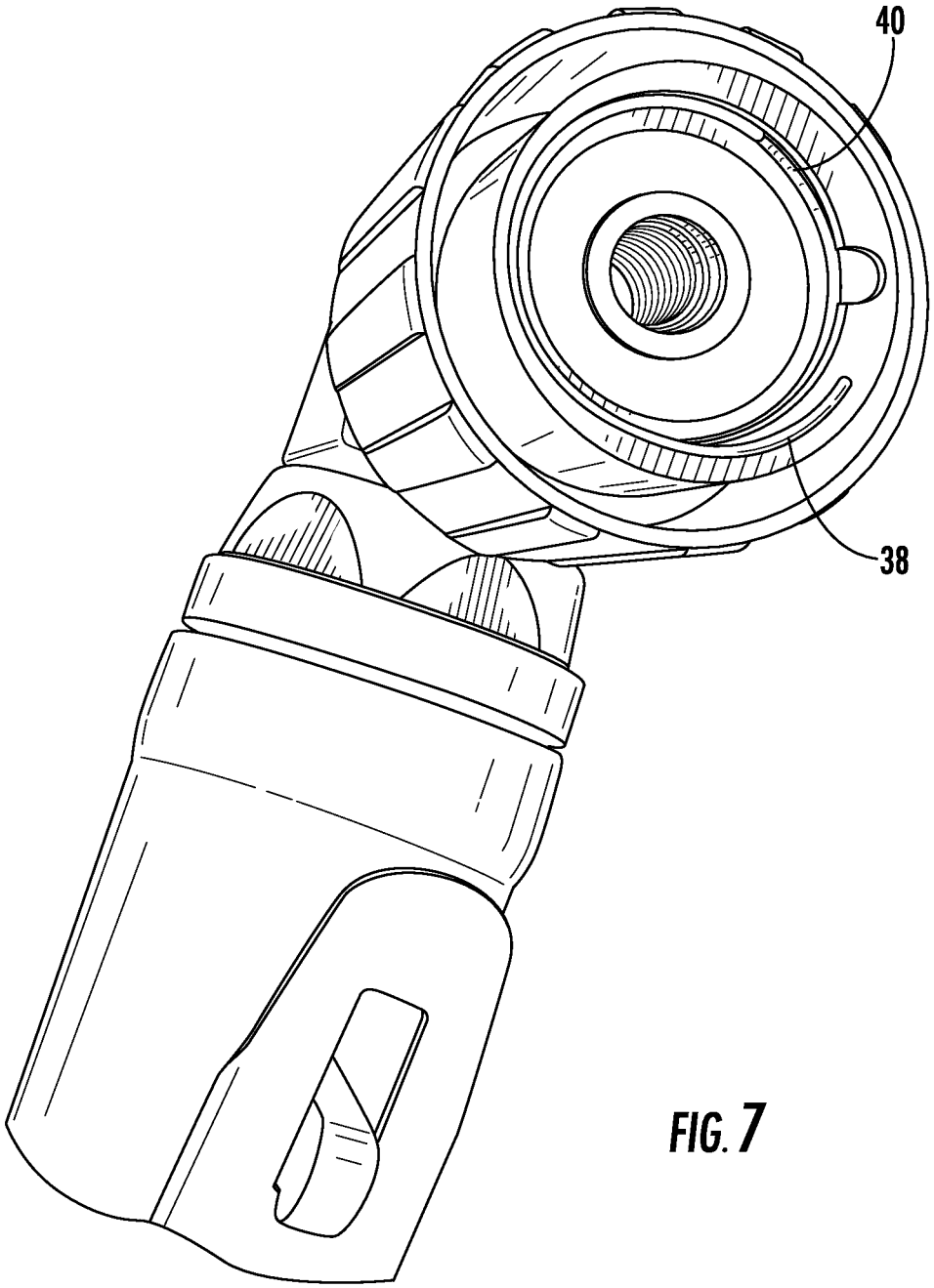
FIG. 7 is a perspective view of the chuck of the handheld orbital sander with the retaining ring partially removed from the groove of the chuck.
Figure 8:
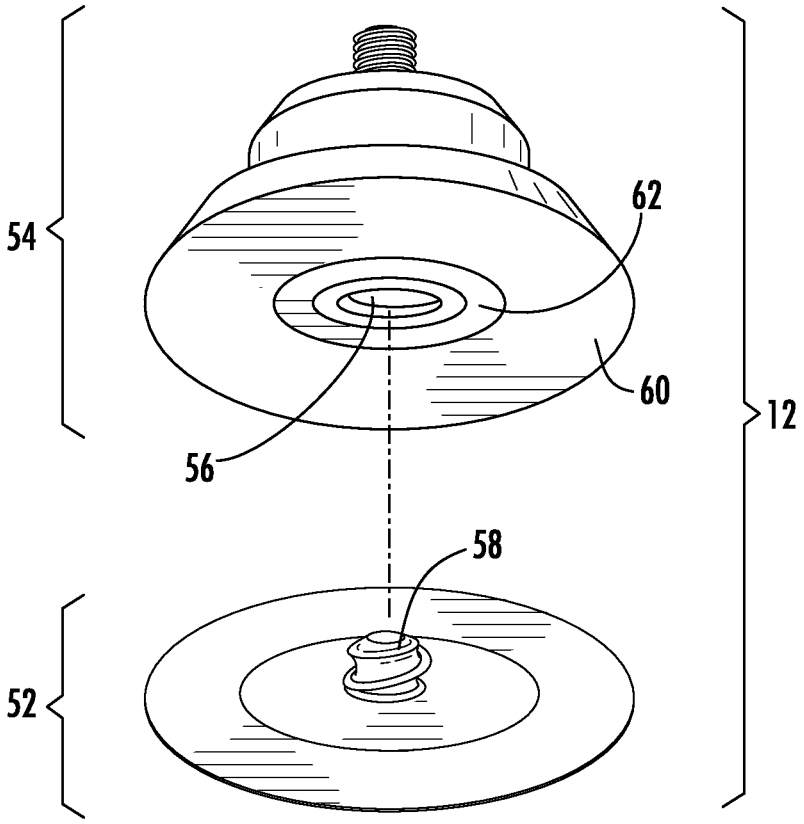
FIG. 8 is an exploded perspective view of the sanding attachment.
Figure 9:
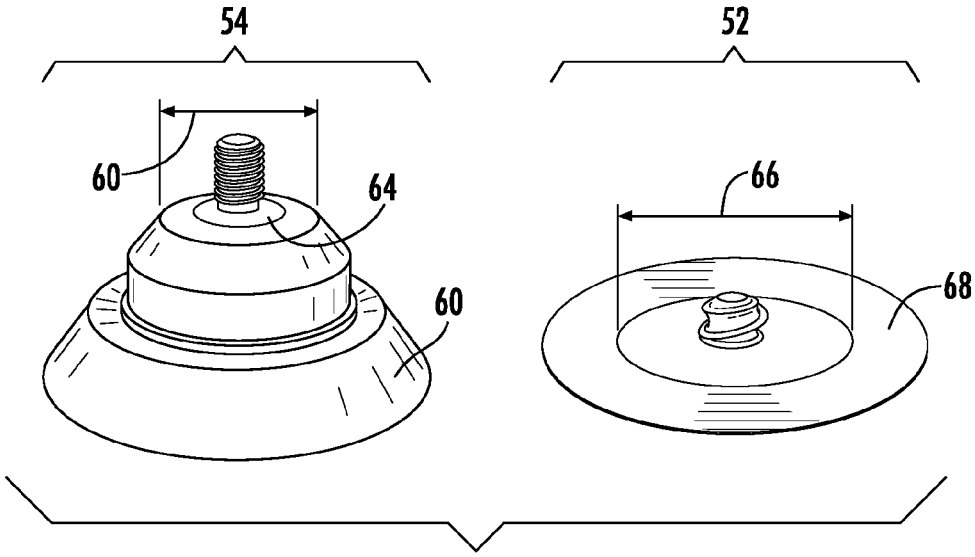
FIG. 9 is a front perspective view of the sanding attachment.

To remove the retaining ring 38 from the groove 40, the chuck 22 has a notch 46 that extends at least partially into the groove 40. When the retaining ring 38 is disposed within the grooves 40, the notch 46 provides space so that a screwdriver 48 may be inserted into the notch 46 to push in the retaining ring 38 in the direction of arrow 50 to dislodge the retaining ring 38 out of the groove 40, as shown in FIG. 7. The retaining ring 38 is removed from the chuck 22 to fix or maintain the orbital sander 10 or the internal parts of the chuck 22.

The sanding pad 12 includes a sanding disk 52 and sanding bit 54. The sanding bit 54 and the sanding disk 52 are removably attachable to each other through a threaded connection. In particular, the bottom side of the sanding bit 54 has a threaded hole 56. Also, the sanding disk 52 has a threaded nub 58. The threaded nub 58 is screwed into the threaded hole 56 to attach the sanding disk 52 to the sanding bit 54 or unscrewed from the threaded hole 56 to remove the sanding disk 52 from the threaded hole 56.

The sanding bit 54 may be fabricated from a resilient polymeric material (e.g., rubber). The outer peripheral portion 60 of the sanding bit 54 may encapsulate an inner central portion 62 fabricated from a metallic or nonrigid material. The threaded hole 56 may be formed in the inner central portion 62. The inner central portion 62 may extend from the bottom surface of the sanding bit 54 to the upper side of the sanding bit 54. The inner central portion 62 provides stability and rigidity to the sanding pad 12 as the user applies pressure onto the metallic surface 16 to conform the outer peripheral portion 60 of the sanding pad 12 to the contour of the metallic surface 16. The inner central portion 62 may have a flat landing 64. The flat landing 64 of the inner central portion 62 may butt up against the flat face of the inner race 32 when the sanding pad 12 is attached to the sander 10. The flat landing 64 provides additional stability during rotation of the sanding pad 12 by the sander 10. This prevents the sanding pad 12 from wobbling during operation.

The sanding pad 12 may have a generally rigid central portion 66. An outer peripheral portion 68 may be flexible and conform to the underside of the outer peripheral portion 60 of the sanding bit 54 as the user pushes down on the sanding pad 12 to conform the sanding pad 12 to the metallic surface 16.

The above description is given by way of example, and not limitation. Given the above disclosure, one skilled in the art could devise variations that are within the scope and spirit of the invention disclosed herein, including various ways of attaching the sanding disc 52 to the sanding bit 54. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A sanding attachment attachable to an orbital sander for deburring machine marks on a metallic surface, the orbital sander having a chuck, the attachment comprising:

a sanding disc having a circular configuration, the sanding disc having a rough side and a mounting side, the rough side being substantially flat, the mounting side having a threaded nub;

a bit comprising:

a rigid base removably attachable to the sanding disc via the threaded nub;

a flexible support extending radially from the rigid base, at least a portion of the flexible support abutting the mounting side of the sanding disc; and a threaded shank extending longitudinally from the rigid base; and a bearing sized to be insertable within the chuck, the bearing comprising:

an outer race; and an inner race spaced from the outer race and rotatable relative to the outer race and engageable with the threaded shank of the bit.

2. The attachment of claim 1 wherein a material of an outer peripheral portion of the flexible support is more flexible than a material of the rigid base.

3. The attachment of claim 2 wherein the outer peripheral portion of the flexible support is sufficiently bendable in order to support the sanding disc when deburring an inside corner having a ¼ inch radius.

4. The attachment of claim 1 wherein a central portion of the rigid base has a threaded hole for receiving the threaded nub of the sanding disc.

5. The attachment of claim 1 wherein the flat area of the base contacts a face of the chuck of the orbital sander.

6. The attachment of claim 1, wherein the rigid base has a hard flat area radially adjacent to the threaded shank, the hard flat area and the inner race of the bearing directly abutting each other when the threaded shank is engaged with the inner race of the bearing, to provide support during orbital rotation of the chuck.

7. A deburring kit for deburring machine marks on a metallic surface, the kit comprising:

a mini orbital sander holdable with one hand, the sander having a recess;

a bearing sized to be received within the recess, the bearing having an inner member that rotates with respect to an outer member, the outer member being spaced from the inner member and retained within the recess, the inner member having a flat face the inner member having a threaded hole; and a sanding attachment comprising:

a sanding disc having a circular configuration, the disc having a rough side and a mounting side, the rough side being substantially flat, the mounting side having a threaded nub;

a bit having a rigid base removably attachable to the sanding disc via threaded engagement with the threaded nub, a flexible support extending radially from the rigid base, and a threaded shank removably attachable to the inner member of the bearing, the rigid base having a hard flat area radially adjacent to the threaded shank, the hard flat area directly contacting the flat face of the inner member when the threaded shank is attached to the inner member to provide support during orbital rotation of the sanding attachment.

8. The kit of claim 7 wherein a material of an outer peripheral portion of the flexible support is more flexible than a material of the rigid base.

9. The attachment of claim 8 wherein the outer peripheral portion of the flexible support is sufficiently bendable in order to support the sanding disc when deburring an inside corner having a ¼ inch radius.

10. The attachment of claim 7 wherein a central portion of the rigid base has a threaded hole for receiving the threaded nub of the sanding disc.

11. The attachment of claim 7 wherein the inner and outer members are inner and outer races that the bearing and the recess is at least partially defined by a chuck which holds the bearing with a retaining ring, the retaining ring having a generally circular shape and being insertable within a groove formed in an inner surface of the chuck.

12. The attachment of claim 11 wherein the generally circular shape of the retaining ring defines two tangentially facing ends.

13. The attachment of claim 12 wherein the retaining ring protrudes inward from the groove a constant distance to provide clearance when the sanding attachment is screwed onto the chuck so that the sanding attachment freely rotates during use.

14. The attachment of claim 11, wherein the outer race is sized for press-fit engagement with the chuck.

* * * * *